US007361105B2

(12) United States Patent
Goeders

(10) Patent No.: US 7,361,105 B2
(45) Date of Patent: Apr. 22, 2008

(54) MULTIPLE PIECE PITCHING MOUND

(75) Inventor: John J. Goeders, Altoona, IA (US)

(73) Assignee: True Pitch, Inc., Altoona, IA (US)

( * ) Notice: Subject to any disclaimer, the term of this patent is extended or adjusted under 35 U.S.C. 154(b) by 240 days.

(21) Appl. No.: 11/164,300

(22) Filed: Nov. 17, 2005

(65) Prior Publication Data

US 2007/0111828 A1 May 17, 2007

(51) Int. Cl.
*A63B 71/00* (2006.01)

(52) U.S. Cl. ..... 473/497; D21/780

(58) Field of Classification Search ..... 473/497, 473/415; D21/780

See application file for complete search history.

(56) References Cited

U.S. PATENT DOCUMENTS 3,479,028 A * 11/1969 Goeders ..... 473/497
4,306,718 A * 12/1981 Goeders ..... 473/497
4,925,186 A 5/1990 Stevenson et al.
D315,382 S * 3/1991 Ragsdale ..... D21/780
5,058,889 A * 10/1991 Burton ..... 473/452
5,213,323 A * 5/1993 Novinsky ..... 473/451
5,624,112 A * 4/1997 Hummel et al. ..... 473/497
2004/0242352 A1* 12/2004 Panus ..... 473/497
2007/0111828 A1* 5/2007 Goeders ..... 473/497

* cited by examiner

*Primary Examiner*—Eugene Kim
*Assistant Examiner*—M. Chambers

(57) ABSTRACT

A portable pitching mound having a plurality of shell pieces that when placed in side by side relation form an arcuate shell member. Each individual shell piece has an interlocking means so that each shell is attached to an adjacent shell. Once all of the shell pieces are in side by side relation, a centrally located supporting cap is attached to the rearward end of each of the plurality of shell pieces to provide additional support.

10 Claims, 2 Drawing Sheets

MULTIPLE PIECE PITCHING MOUND

BACKGROUND OF THE INVENTION

This invention relates to portable pitching mounds. More specifically this invention relates to a multiple piece portable pitching mound that is able to be easily transported.

Portable pitching mounds have served well to provide pitching mounds where conventional mounds could not be used (i.e., gymnasiums) or were not available. However, the footing or traction on the surface of the mounds is not the best, particularly as the pitcher completes the pitching motion. Further, the means of securing these mounds to a supporting surface are not always adaptable for both indoor and outdoor use. Additionally, many portable pitching mounds use vertical walls as support that can add extra weight to the mound as well as making it difficult to use both indoors and outdoors.

Portable pitching mounds that do not use vertical walls and have a single peripheral edge have been provided to overcome the problems associated with pitching mounds having vertical wall portions. However, many problems remain with these portable pitching mounds. For example, a regulation pitcher's mound is ten inches high, five feet wide, and 34 inches from front to back with an 18 foot diameter and thus are very large. Because of the unusual shape and size of a pitching mound, transporting pitching mounds to stores to sell provides difficulties. Additionally, when indoor use in a gymnasium of a mound is desired, transporting a mound inside the door of a gymnasium is also problematic. Manufacturing such a large mound is also expensive and difficult.

Thus an object of the present invention is to provide a portable pitching mound that improves upon the state of the art.

Another object of the present invention is to provide a portable pitching mound that is easy to transport.

Yet another object of the present invention is to provide a portable pitching mound that is easy to assemble.

These and other objects, features, or advantages of the present invention will become apparent from the specification and claims.

BRIEF SUMMARY OF THE INVENTION

A portable pitching mound having a plurality of shell pieces that when placed together in side by side relation form an arcuate shell member. Each shell piece has an interlocking means that is used to secure the pieces together. Additionally, a centrally located supporting cap attaches and supports all of the shell pieces. Located on the supporting cap is a pitching rubber and at least one of the shell pieces has a depression area that has a panel mounted therein and extends from the pitching rubber to the end of the shell piece to provide frictional footing for a pitcher. Thus the portable pitching mound does not use vertical wall portions.

DETAILED DESCRIPTION OF THE PREFERRED EMBODIMENT

Figure 1:
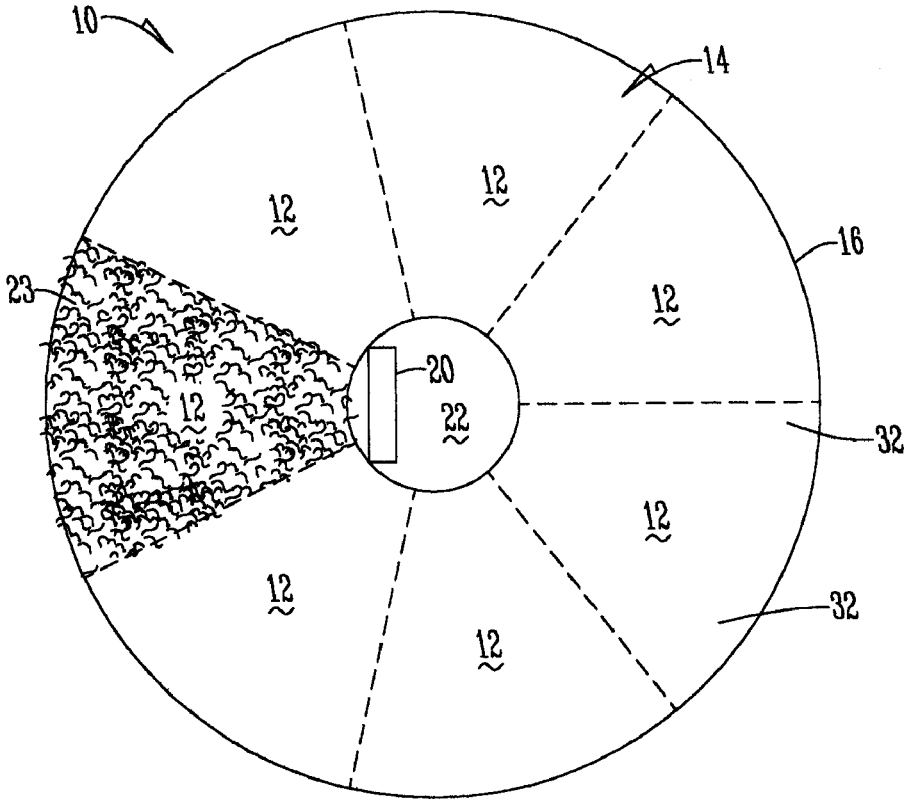
FIG. 1 is a perspective view of a portable pitching mound.

The numeral 10 designates a mound that is formed from a plurality of mound or shell pieces 12 that when placed in a side by side relation form a Fiberglass shell 14 of oval shape and arcuate in cross section. In a preferred embodiment eight mound pieces 12 are used. The mound 10 is supported by a lower peripheral edge 16 to which is glued a strip of frictional material 18 such as AstroTurf® or the like. A pitching rubber 20 is secured to a centrally located supporting cap 22 that is secured to and supports each of the shell pieces 12. In a preferred embodiment the mound piece 12 in front of the pitching rubber 20 has a layer of grass like material 23 secured thereon that extends over and is detachably secured to the cap 22 such that the grass like material 23 is adjacent the rubber 20. The grass like material 23 provides a landing area for a pitcher. Other frictional materials may also be used.

Figure 2:
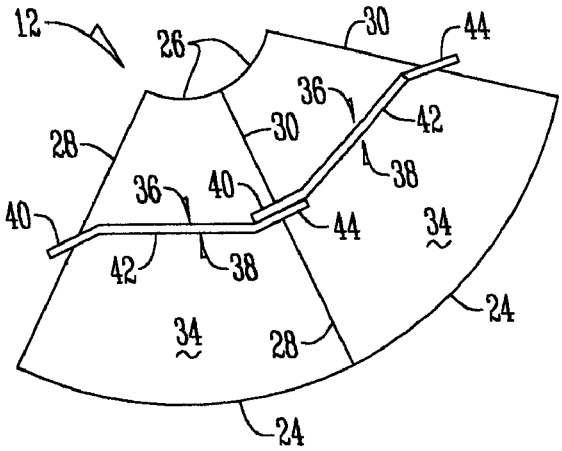
FIG. 2 is a bottom plan view of a piece of a portable pitching mound have an interlocking means.
Figure 3:
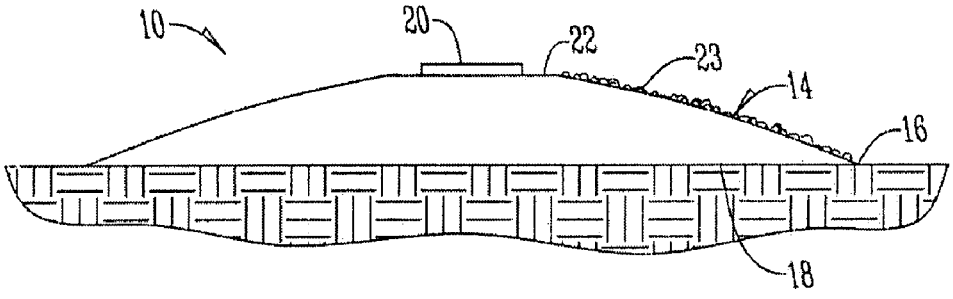
FIG. 3 is a sectional view of a portable pitching mound.

FIG. 2 shows an individual mound piece 12. The mound piece 12 in a preferred embodiment is wedge shaped having a forward arcuate end 24 and a rear end 26. Extending in between the forward and rearward ends 24 and 26 are first and second opposite side portions 28 and 30. Each mound piece 12 additionally has an upper surface 32 and a lower concave surface or underside 34.

Figure 4:
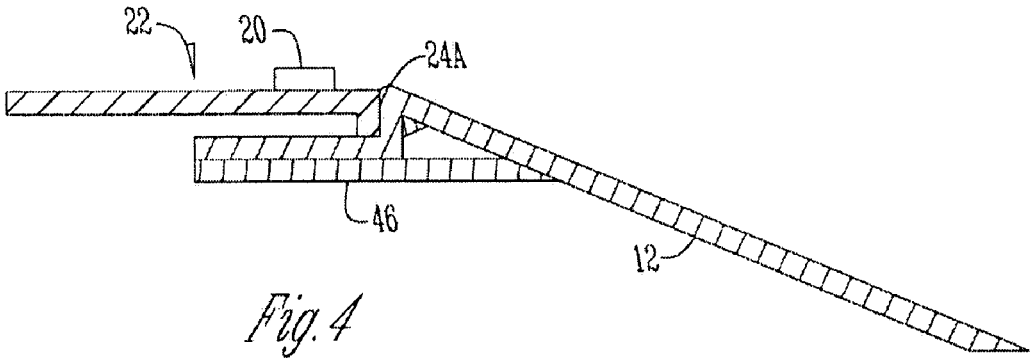
FIG. 4 is a sectional view of a portable pitching mound.

The mound piece 12 has an interlocking means 36 associated therewith to attach and secure other mound pieces thereto. As shown in FIG. 2 in a preferred embodiment, the interlocking means 36 of mound piece 12 is located on and is secured to the lower concave surface 34 of the mound piece 12. In FIG. 2 interlocking means 36 comprises an S-shaped member 38 having a first angled portion 40 that extends past the first side portion 28 of the mound piece 12. Extending from the first angled portion 40 is a second angled portion 42 that extends along the length of the mound piece and terminates in a third angled portion 44 that extends past the second opposite side portion 30 of the mound piece 12. When two mound pieces 12 are placed side by side such that side 28 of one mound piece 12 is aligned with side 30 of a separate mound piece, the first angled portion 40 and the first mound piece 12 interlocks with a third angled portion 44 of a second mound piece thus interlocking the two mound pieces 12 together. The shell piece 12 is connected to the cap 22 in a variety of ways. In one example, as shown in FIG. 4, the shell piece 12 has a lower shelf or flange 46 that extends outwardly from and is positioned below the outer peripheral edge of the cap 22. The flange 46 is positioned to create a space between the flange 46 and the lower surface of the cap 22 to receive the upper end 24A of shell 12. The upper end 24A is preferably L-shaped such that a horizontal portion slides within the opening and a vertical portion engages the outer edge of the cap 22. In this manner, the shell 12 is easily connected to the cap 22 and the proper angle of the shell 12 in relation to the cap 22 is created by the connection.

Figure 5:
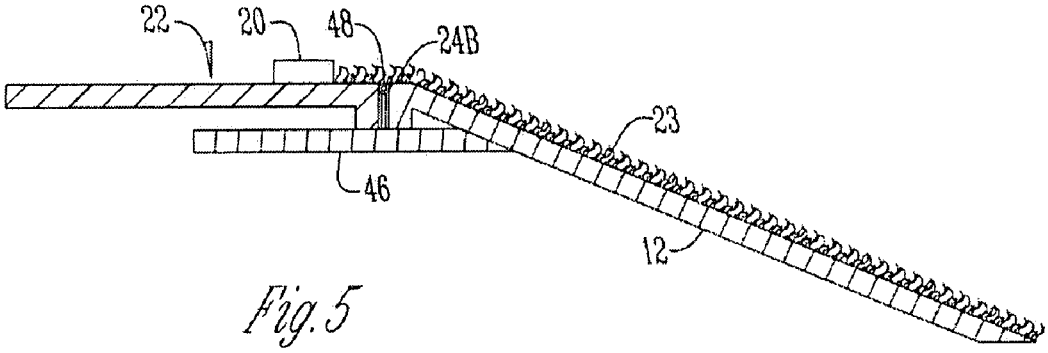
FIG. 5 is a sectional view of a portable pitching mound.

Alternatively, as shown in FIG. 5, the upper end 24B is formed as a hook 48 and the flange 46 has an L-shape with a horizontal and vertical portion. The hook 48 fits over the vertical portion of flange 46 and engages the outer edge of cap 22 so that the desired, angle of the shell 12 in relation to the cap 22 may be set.

Once all of the mound pieces 12 are placed together to form the arcuate shell 14, the supporting cap 22 is centrally located and attached to the rear end 26 of each mound piece 12 to secure and support each mound plate 12 in place. After the mound pieces 12 are in place, the forward arcuate end 24 of each mound piece forms the peripheral edge 16 of shell 14.

In the preferred embodiment the interlocking means 30 is an S-shaped member that interlocks. Alternatively, the interlocking means 36 is any device, mechanism, or design that secures two mound pieces 12 together. For example only, this includes all fastening means such as nails, bolts, zippers, tape, zip lock, hooks and loops, and the like that secures a first mound piece 12 to a second mound piece 12.

By making the mound 10 comprise a plurality of mound pieces 12 during transportation the mound 10 is broken into the individual pieces making the mound 10 easier to store and ship. Additionally, during the manufacturing process each mound piece 12 is individually created by using a mold that is inexpensive and easy to maintain as compared to a mold used to create an entire single piece mound 10. From the foregoing, it is seen that the invention accomplishes at least all of its stated objectives.

It will be appreciated by those skilled in the art that other various modifications could be made to the device without the parting from the spirit in scope of this invention. All such modifications and changes fall within the scope of the claims and are intended to be covered thereby.

What is claimed is:

1. A portable pitching mound, comprising:

a plurality of shell pieces each having forward and rearward ends, opposite side portions, an upper surface and an opposite generally concave underside, such that when the pieces are placed in side by side relation the plurality of pieces form an arcuate shell member;

an interlocking member on each of the plurality of shell pieces for securing the plurality of pieces together when the plurality of pieces are placed in side by side relation;

a centrally located supporting cap that attaches to and supports the rearward end of each of the plurality of shell pieces wherein the shell piece has a flange that extends outwardly from and is positioned below an outer peripheral edge of the supporting cap and a pitching rubber mounted on the centrally located supporting cap and wherein the interlocking member comprises an S-shaped member having a first angled portion that extends beyond a side portion of a shell piece, a second angled portion extending from the first angled portion and across the underside of the shell piece, and a third angled portion extending from the second angled portion and extends beyond an opposite side portion of the shell piece.

2. The portable pitching mound of claim 1 wherein each shell piece has an arcuate forward end such that when the pieces are placed in side by side relation the arcuate forward ends form a peripheral edge.

3. The portable pitching mound of claim 2 wherein the arcuate shell member has a strip of frictional material secured to said peripheral edge to cause said shell member to frictionally engage a supporting surface,.

4. The portable pitching mound of claim 1 wherein the plurality of shell pieces comprises eight shell pieces.

5. The portable pitching mound of claim 1 wherein a grass like material is secured to at least one shell piece and is detachably secured to the supporting cap adjacent the pitching rubber.

6. The portable pitching mound of claim 1 wherein the flange is positioned to create a space between the flange and a lower surface of the supporting cap.

7. The portable pitching mound of claim 6 wherein the rearward end of the shell piece is L-shaped such that a horizontal portion slides within a centrally located opening and a vertical portion engages the outer peripheral edge of the supporting cap.

8. A portable pitching mound, comprising:

a plurality of shell pieces each having forward and rearward ends, opposite side portions, an upper surface and an opposite generally concave underside, such that when the pieces are placed in side by side relation the plurality of pieces form an arcuate shell member;

an interlocking member on each of the plurality of shell pieces for securing the plurality of pieces together when the plurality of pieces are placed in side by side relation;

a centrally located supporting cap that attaches to and supports the rearward end of each of the plurality of shell pieces wherein the rearward end of the shell piece has a hook and an L-shaped flange having a horizontal portion and a vertical portion; and a pitching rubber mounted on the centrally located supporting cap and wherein the interlocking member comprises an S-shaped member having a first angled portion that extends beyond a side portion of a shell piece, a second angled portion extending from the first angled portion and across the underside of the shell piece, and a third angled portion extending from the second angled portion and extends beyond an opposite side portion of the shell piece.

9. The portable pitching mound of claim 8 wherein the hook engages the supporting cap.

10. A portable pitching mound, comprising:

a plurality of shell pieces each having forward and rearward ends, opposite side portions, an upper surface and an opposite generally concave underside, such that when the pieces are placed in side by side relation the plurality of pieces form an arcuate shell member;

an interlocking member on each of the plurality of shell pieces for securing the plurality of pieces together when the plurality of pieces are placed in side by side relation;

a centrally located supporting cap that attaches to and supports the rearward end of each of the plurality of shell pieces such that a single peripheral edge supports the portable pitching mound without vertical support walls; and a pitching rubber mounted on the centrally located supporting cap and wherein the interlocking member comprises an S-shaped member having a first angled portion that extends beyond a side portion of a shell piece, a second angled portion extending from the first angled portion and across the underside of the shell piece, and a third angled portion extending from the second angled portion and extends beyond an opposite side portion of the shell piece.

* * * * *